US005795271A

United States Patent [19]

Pearson

[11] Patent Number: 5,795,271

[45] Date of Patent: Aug. 18, 1998

[54] EXERCISE MACHINE

[76] Inventor: Bob Larry Pearson, 4868 Cottonwood Rd., Memphis, Tenn. 38118

[21] Appl. No.: 678,227

[22] Filed: Jul. 11, 1996

[51] Int. Cl.[6] ..... A63B 69/06; A63B 21/008; A63B 21/00

[52] U.S. Cl. ..... 482/72; 482/142; 482/111; 482/92

[58] Field of Search ..... 482/100, 112, 482/133, 136, 137, 138, 142, 148, 72, 146, 96, 56, 92; 601/23, 24, 25; 606/242, 243, 244, 245

[56] References Cited

U.S. PATENT DOCUMENTS

| | | | |
|---|---|---|---|
| 1,626,091 | 4/1927 | Mackliw | 606/242 X |
| 4,429,871 | 2/1984 | Flechner | 482/138 X |
| 4,556,216 | 12/1985 | Pitkanew | 482/137 X |
| 4,711,447 | 12/1987 | Mansfield | 482/63 X |
| 5,360,383 | 11/1994 | Boren | 482/100 X |
| 5,454,773 | 10/1995 | Blanchard | 482/133 |

FOREIGN PATENT DOCUMENTS

| | | | |
|---|---|---|---|
| 0107735 | 11/1924 | Switzerland | 606/245 |

*Primary Examiner*—Richard J. Apley
*Assistant Examiner*—William LaMarca
*Attorney, Agent, or Firm*—Glassman, Jeter, Edwards & Wade, P.C.

[57] ABSTRACT

An exercise machine having a frame, a vertical shaft connected to the vertical shaft for rotation about a horizontal axis. Pneumatic cylinders are connected to the frame to selectively resist the movement of the vertical shaft and the lever arms. The lever arms may be operated independently or in unison. A first user support pad is slidably connected to the frame and two additional support pads are pivotally and detachably connected to the first support pad. Telescopic support arms are pivotally connected to the frame and additional user support pads to maintain the additional support pads in selected angular relationship to the first support pad.

17 Claims, 4 Drawing Sheets

EXERCISE MACHINE

FIELD OF THE INVENTION

The present invention relates to exercise machines having lever arms against which a user may exert a physical force. More particularly, the present invention relates to exercise machines operable from several positions for strengthening a variety of the users muscle groups.

BACKGROUND OF THE INVENTION

Exercise machines are available on the market in a plurality of styles and combinations. What was once an expensive and bulky contraption found only in gyms and health spas has developed into a variety of compact, relatively inexpensive machines which can be easily used and stored in a user's home. However, as exercise machines have been reduced in size to accommodate home use, the variety of exercise positions provided by the larger machines and muscle groups strengthened thereby was reduced as well.

Bench press machines, rowing machines, curling machines, and an endless number of other specialized exercise machines are available. What is needed, however, is an exercise machine that is compact in design, but incorporates a maximum number of exercise features.

SUMMARY OF THE INVENTION

It is the principal object of the present invention to provide a compact exercise machine that provides a maximum number of exercise positions for the user to utilize in strengthening a maximum number of muscle groups.

In support of the principal object, another object of the present invention is to provide a exercise machine with an adjustable user support platform which may be set to a variety of positions to assist and support the user in a number of selected exercises.

Also in support of the principal object, yet another object of the present invention is to provide resistive lever arms which selectively pivot about both vertical and horizontal axis to maximize the number of exercise positions and routines available to the user.

These and other objects and advantages of the present invention are accomplished through the use of a frame having a first user support pad slidably attached to a top portion thereof. A second user support pad is detachably and pivotally attached to the first user support pad. A third user support pad is detachably and pivotally attached to the first user support pad opposite the second user support pad. A first telescopic support arm is pivotally connected to the frame and to the second user support pad to selectively position and support the second user support pad in selected angular relationships to the first user support pad. A second telescopic support arm is pivotally connected to the frame and to the third user support pad to selectively position and support the third user support pad in selected angular relationships to the first user support pad.

A vertical shaft is rotably connected to the frame subjacent to the first user support pad for rotation about a vertical axis. A horizontal flange is connected to the vertical shaft in coaxial relation thereto. One or more holes are defined by the horizontal flange in circular disposition thereon. One or more pneumatic piston and shaft cylinders are pivotally connected to the frame and detachably connected to the horizontal flange by a pin connected to each piston and shaft cylinder and slidably received in a selected one of the one or more holes defined by the horizontal frame. A lock pin may be received within one of the holes and threadably engaged within a threaded base defined by the frame to selectively lock the horizontal flange and vertical shaft in a fixed non-rotational position.

A pair of tubular lever hubs are connected to the vertical shaft in diametrically opposed relation thereon and extend horizontally therefrom. A shaft bore is defined by the vertical shaft and the tubular lever hubs. An elongated cylindrical shaft is received within the shaft bore for rotational movement therein about a horizontal axis.

Two L-shaped tubular lever arms are provided, each having a shaft engaging portion and a leverage position. The shaft engaging portion of each leverage arm slidably receives an opposite end of the cylindrical shaft. Each leverage arm defines two flanges connected to the shaft engaging portion, the first of which is engaged by a pair of C-shaped semi-circular flange hubs connected to a corresponding one of the lever hubs. The second flange defines a plurality of holes in circular disposition thereon. Pneumatic piston and shaft cylinders are attached to the frame and may be selectively attached to the second flanges using pins which are connected to the cylinders and selectively inserted within selected ones of the holes defined by the second flange. Pins are provided to selectively secure one or both lever arms to the cylindrical shaft in fixed non-rotational relation thereto such that the lever arms may be rotated individually or concurrently. A pin is provided to selectively secure the cylindrical shaft in fixed non-rotational relation to the vertical shaft.

In operation, the present invention can accommodate a number of exercise positions and routines. The vertical shaft may be secured, the lever arms secured to the horizontal shaft and the horizontal shaft left free to rotate within the vertical shaft and tubular lever hub to accommodate motion of the lever arms about a horizontal axis. With pneumatic and piston shaft cylinders attached to the second flanges, the user may rotate the lever arms in a sitting position to replicate a rowing exercise or from a lying position to replicate a bench press. The second user support pad may be fixed in an incline position to assist the user in performing an incline bench press. The lever arms may be set at a variety of angles by inserting the piston and shaft cylinder pins in a selected one of the one or more holes defined by the second flanges. The pin securing the lever arms to the cylindrical shaft may be disengaged to permit independent rotation of each lever arm or without the cylindrical shaft.

Note also that the vertical shaft can be released for movement about a vertical axis with the horizontal cylindrical shaft and the lever arm secured in a stationery position. This configuration allows the user to rotate the lever arms without a vertical axis. With one or more of the pneumatic piston and shaft cylinders attached to the horizontal flange, the user can perform a twisting exercise intended to strengthen the user's upper back muscles and arms. The number of exercise positions and routine capable of being performed with the present invention are not limited to this discussion but are as numerous as the imagination of the user. The flexibility of the user support pads in combination with the combined vertical and horizontal rotation lever arms have provided an exercise machine with limited versatility.

DESCRIPTION OF THE DRAWINGS

Apparatus embodying features of my invention are depicted in the accompanying drawings which form a portion of this disclosure and wherein.

DESCRIPTION OF A PREFERRED EMBODIMENT

Figure 1:
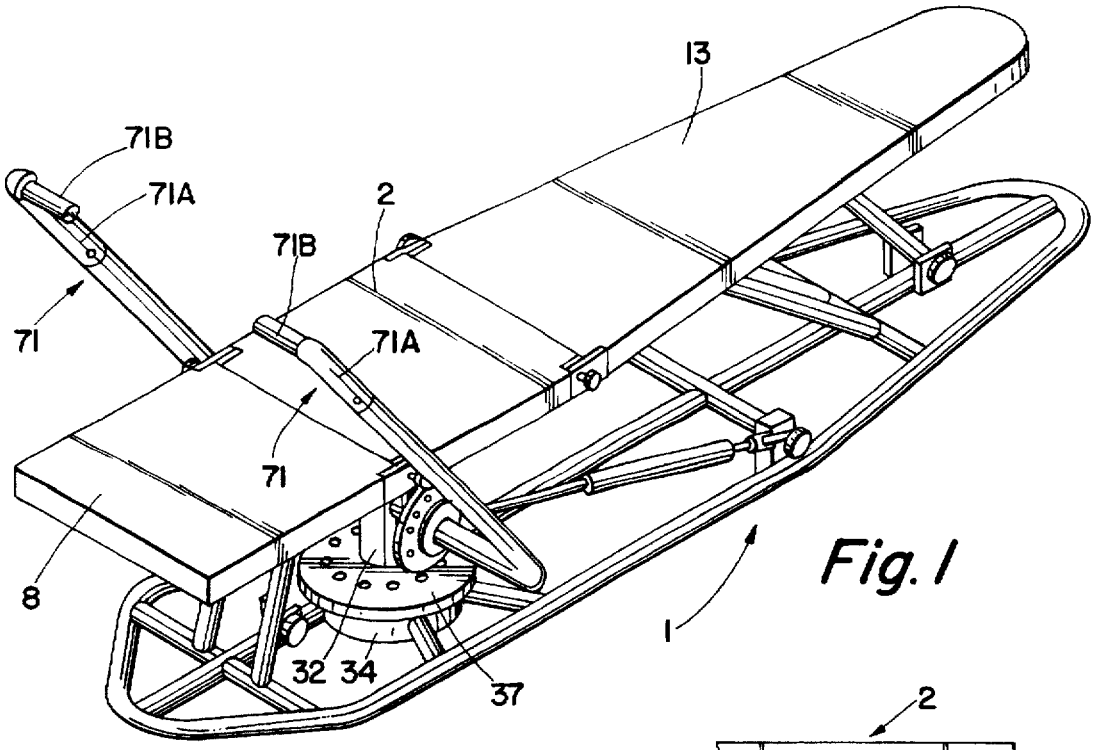
FIG. 1 is a perspective view of the invention.
Figure 3:
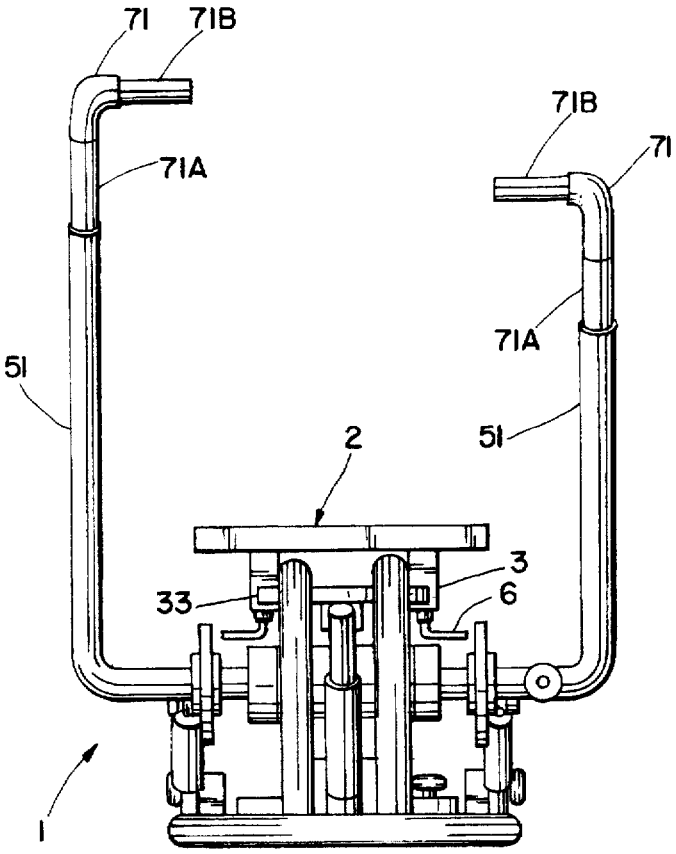
FIG. 3 is a front elevational view of the invention.
Figure 4:
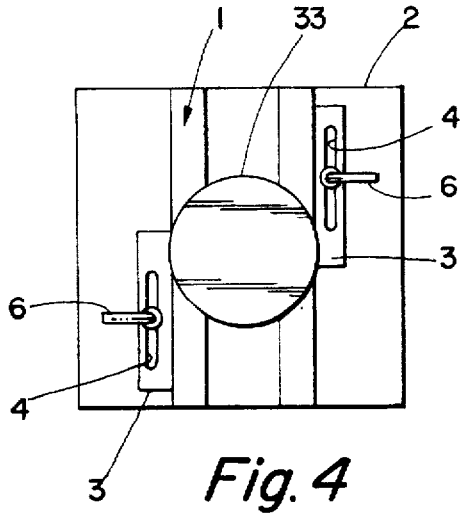
FIG. 4 is the sectional view taken along Line 4—4 of FIG. 2.
Figure 5A:
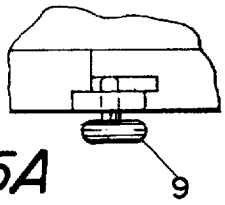
FIG. 5A is a detailed view of the pins shown in FIG. 5.
Figure 5:
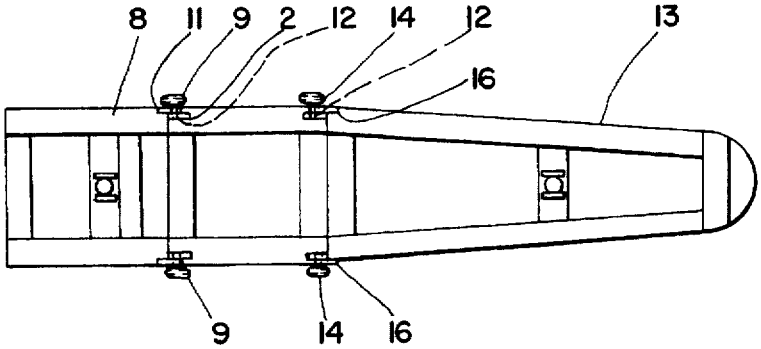
FIG. 5 is a bottom view of the first, second, and third user support pads.
Figure 6:
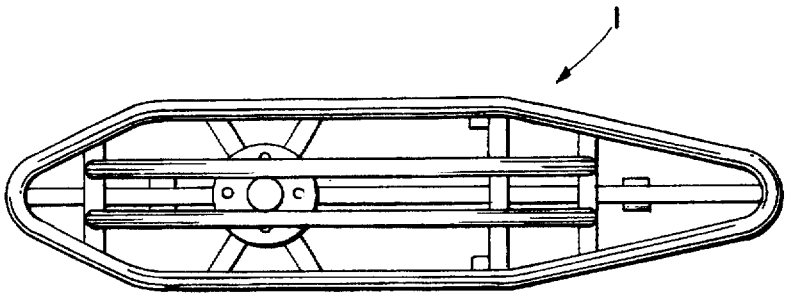
FIG. 6 is a top plan view of the frame.
Figure 7:
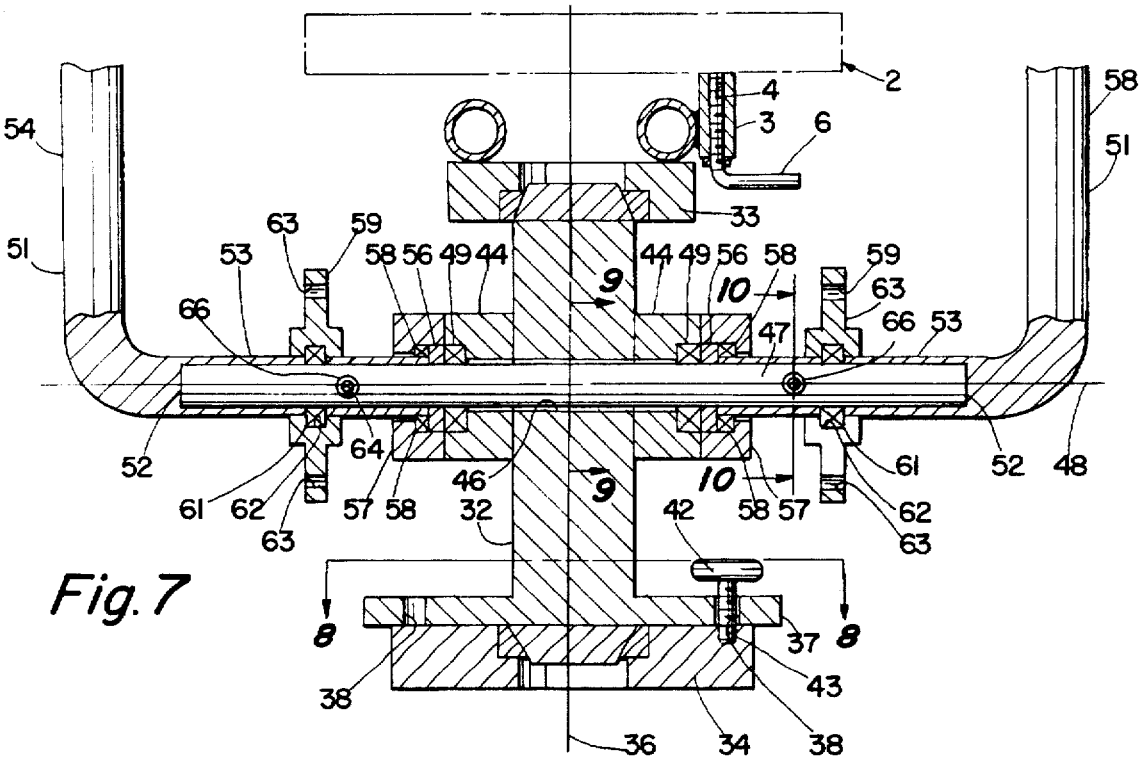
FIG. 7 is the sectional view taken along Line 7—7 of FIG. 2.
Figure 8:
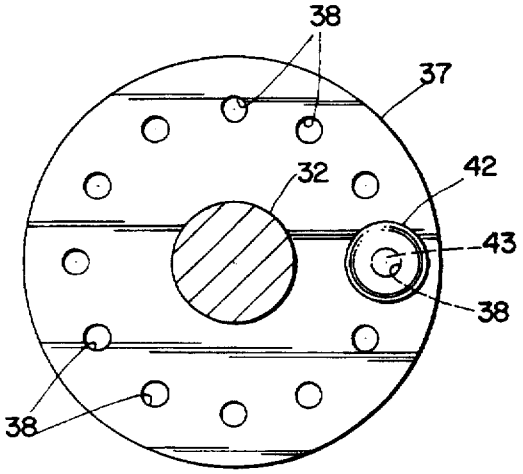
FIG. 8 is a sectional view taken along Line 8—8 of FIG. 7.

Referring to FIGS. 1 and 6 of the drawing for a clearer understanding of the invention, it should be noted that the preferred embodiment of the invention includes a frame 1 having a first user support pad 2 slidably connected thereto. As shown in FIGS. 3 and 4, two plates 3 are connected to the frame, each defining a slot 4 through which a threaded pin 6 extends is shown in FIG. 7. The pins 6 are threadably received within corresponding threaded bores 7, defined by the first user support pad 2, to selectively secure the first user support pad 2 in pressed non-sliding relation to the frame 1.

As shown in FIGS. 1, 2, 5 and 5A, a second user support pad 8 is detachably and pivotally connected to the first user support pad 2. Threaded pins 9 extend through eyelets 11, which are connected to and form a part of the second user support pad 8 and are threadably received within threaded bores 12 defined by the first user support pad 2. A third user support pad 13 is detachably and pivotally connected to the first user support pad 2. Threaded pins 14 extend through eyelets 16 which are connected to and form a part of the third user support pad 13 and are threadably received within threaded bores 12 defined by the first user support pad 2.

Figure 2A:
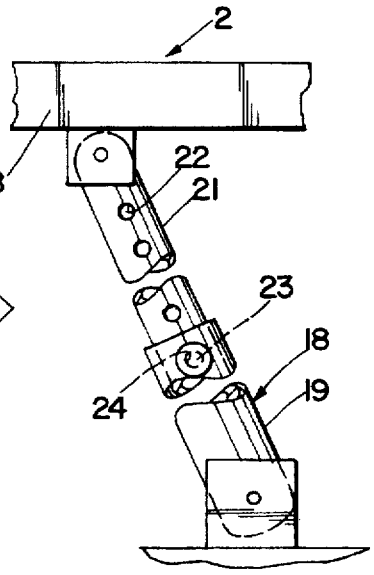
FIG. 2A is a detailed view of a telescopic first support arm 18.
Figure 2:
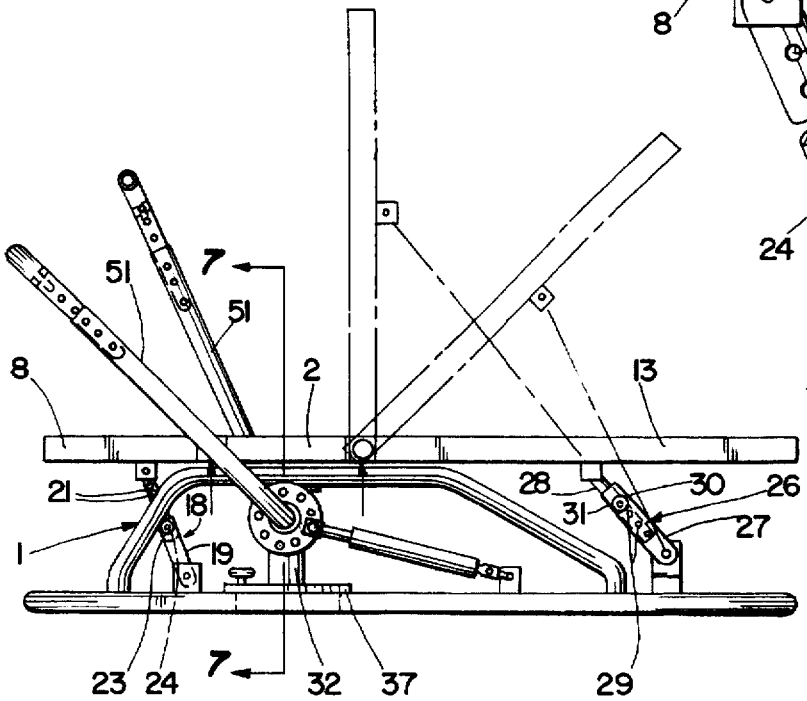
FIG. 2 is a side elevational view of the invention.

As shown in FIGS. 2 and 2A, a telescopic first support arm 18 is pivotally connected to the frame 1 and pivotally and detachably connected to the second user support pad 8 to support the second user support pad 8 in selected angular relations to the first user support pad. The first support arm 18 includes a first sheath 19 pivotally connected to the frame 1 and a first rod 21 slidably received within the first sheath 19 and pivotally and detachably connected to the second user support pad 8. The first rod 21 defines a plurality of holes 22 spaced lengthwise thereon. A pin 23 is selectively received within holes 24 defined by the first sheath 19 and a selected one of the holes 22 to support the first rod 21 at a selected extension from the first sheath 19.

A telescopic second support arm 26 is pivotally connected to the frame 1 and pivotally and detachably connected to the third user support pad 13 to support the third user support pad 13 in selected angular relations to the first user support pad 2. The second support arm 26 includes a second sheath 27 pivotally connected to the frame 1 and a second rod 28 slidably received within the second sheath 27 and pivotally and detachably connected to the third user support pad 13. The second rod 28 defines a plurality of holes 29 spaced lengthwise thereon. A pin 30 is selectively received within hole 31 defined by the second sheath 27 and a selected one of the holes 29 to support the second rod 28 at a selected extension from the second sheath 27. It should be noted that several interchangeable first rods 21 and second rods 28, all having different lengths, are anticipated for use in supporting the second an third user support pads 8 and 13 in a wide array of angular relations with the first user support pad 2.

Figure 11:
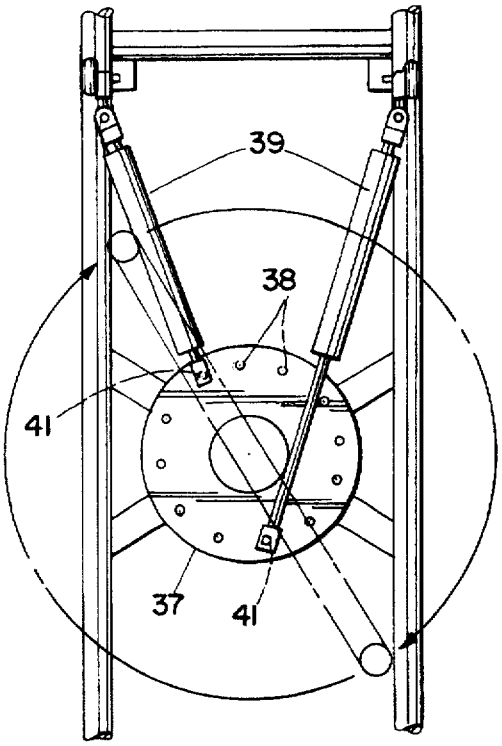
FIG. 11 is atop plan view of the frame vertical cyclinder horizontal flange and pneumatic piston and shaft cylinders.
Figure 12:
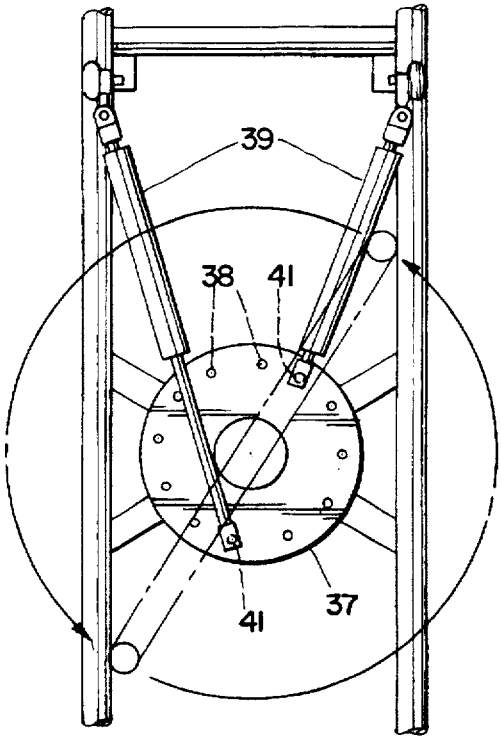
FIG. 12 is a top plan view of the frame vertical cyclinder horizontal flange and pneumatic piston and shaft cylinders
Figure 13:
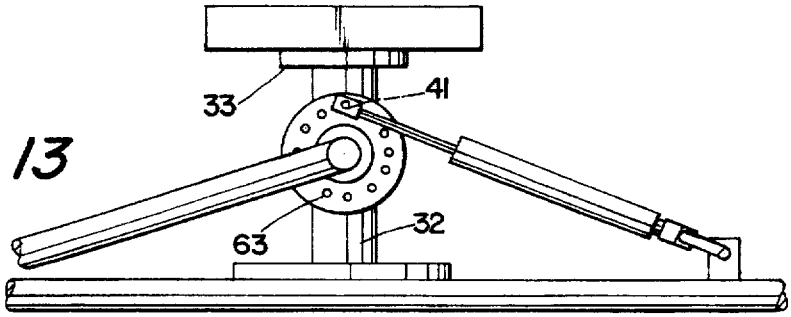
FIG. 13 is a detailed view of the vertical cylinder with the pneumatic piston and shaft cylinder connected to the first vertical flange.
Figure 14:
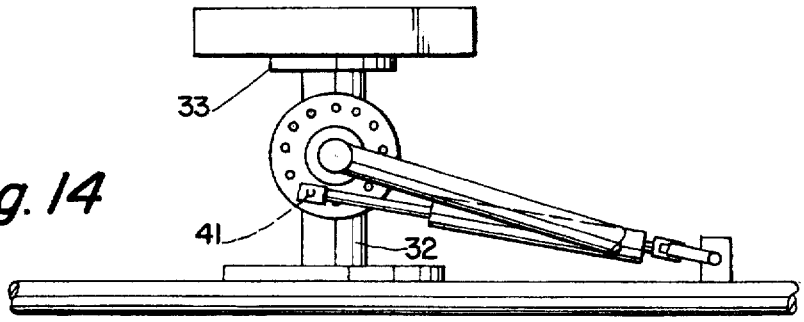
FIG. 14 is a detailed view of the vertical cylinder with the pneumatic piston and shaft cylinder connected to the first vertical flange with the deeper arms rotated and substantially opposite relation to that as shown in FIG. 13.

As is shown in FIGS. 7, 13 and 14, a vertical shaft 32 is rotably connected to the frame 1 by an upper bearing block 33, connected to and forming a part of, the frame 1 subjacent the first user support pad 2, and a lower bearing block 34 connected to, and forming a part of, the frame 1 opposite the upper bearing block 33. The vertical shaft 32 rotates around a vertical axis 36 and has a horizontal flange 37 connected coaxially thereto proximate the lower bearing block 34. A plurality of holes 38 are defined by the horizontal flange 37 in circular disposition thereon. A pair of pneumatic piston and shaft cylinders 39 are pivotally connected to the frame 1 and as shown in FIGS. 11 and 12, may be detachably connected to the horizontal flange 37 by inserting a pin 41 which is pivotally connected to each piston and shaft cylinder 39 within a selected one of the plurality of holes 38. A locking pin 42 may be selectively inserted through a hole 38 and threadably received within a threaded bore 43 to lock the horizontal flange 37 and vertical shaft 32 in fixed non-rotating relation to the frame 1.

As shown in FIG. 7, two tubular rotator hubs 44 are connected to the vertical shaft 32 in diametrically opposed relation thereon and extend horizontally therefrom. The rotator hubs 44 and the vertical shaft 32, define a shaft bore 46 through which a cylindrical rotator shaft 47 is received for rotational movement about a horizontal axis 48. Roller bearings 49 are seated within the rotator hubs 44 to facilitate smooth unresisted rotary movement of the rotator shaft 47 within the shaft bore 46.

A pair of L-shaped and cross-sectionally tubular lever arms 51 slidably engage opposing ends 52 of the rotator shaft 47. Each lever arm 51 includes a shaft engaging portion 53 and a leverage portion 54 disposed in substantially perpendicular relation to the shaft engaging portion 53. A first vertical flange 56 is connected to each lever arm 51 proximal a distal end of the shaft engaging portion 53. The first flanges 56 are engaged by a plurality of flange hubs 57 which are each detachably connected to a rotator hub 44 to secure the first vertical flange 56 in proximity to a corresponding rotator hub 44. Roller bearings 58 are seated within the flange hubs 57 and against the shaft engaging portions 53 of the lever arms 51 to facilitate smooth rotation of the lever arm 51 within the flange hubs 57.

A second vertical flange 59 is connected to each shaft engaging portion 53 of the lever arms 51 in parallel planer relation to the first vertical flanges 56. Roller bearings 61 are seated within channels 62 defined by the second flanges 59 and the shaft engaging portions 53 to facilitate smooth rotary movement of the shaft engaging portion 53 about the rotator shaft 47. As shown in FIGS. 7, 13 and 14, Holes 63 are defined by the second vertical flanges 59 for receiving a pin 41 to detachably connect a selected piston and shaft cylinder 39 to the second vertical flange 59.

Figure 9:
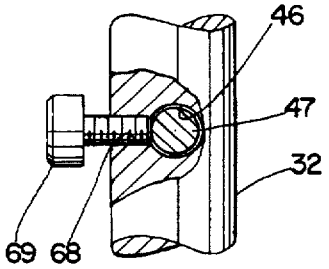
FIG. 9 is a detailed partially broken view taken along Line 9—9 of FIG. 7.
Figure 10:
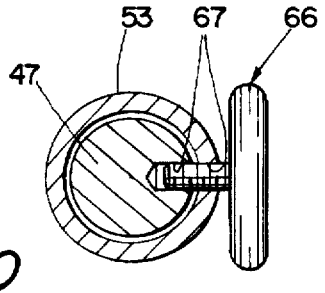
FIG. 10 is a sectional view taken along Line 10—10 of FIG. 7.

As shown in FIGS. 7 and 10, hole 64 is defined by each lever arm 51 in which a threaded pin 66 may be selectively inserted and threadably received within one of two threaded bores 67 defined by the rotator shaft 46. As shown in FIG. 9, a threaded bore 68 is defined by the vertical shaft 32 for receiving a threaded pin 69 selectively screwed therein and against the rotator shaft 47 to selectively secure the rotator shaft 47 in fixed non-rotational relation to the vertical shaft 32.

Handles 71 are slidably and detachably connected to the lever arms for purposes of gripping by the user. Note that the Handles 71, shown in FIG. 1 include two gripping members 71A and 71B which extend in substantially perpendicular relation. The gripping members of 71A and 71B accommodate the use of the lever arms about both a vertical and a horizontal axis. Other handles (not shown) are anticipated and may be detachably connected to the lever arms to accommodate the specific exercise being performed by the user.

In operation, the present invention can accommodate a number of exercise positions and routines. The vertical shaft may be secured, the lever arms secured to the horizontal shaft and the horizontal shaft left free to rotate within the vertical shaft and tubular lever hub to accommodate motion of the lever arms about a horizontal axis. With pneumatic and piston shaft cylinders attached to the second flanges, the user may rotate the lever arms in a sitting position to replicate a rowing exercise or from a lying position to replicate a bench press. The second user support pad may be fixed in an incline position to assist the user in performing an incline bench press. The lever arms may be set at a variety of angles by inserting the piston and shaft cylinder pins in a selected one of the one or more holes defined by the second flanges. The pin securing the lever arms to the cylindrical shaft may be disengaged to permit independent rotation of each lever arm or without the cylindrical shaft.

Note also that the vertical shaft can be released for movement about a vertical axis with the horizontal cylindrical shaft and the lever arm secured in a stationery position. This configuration allows the user to rotate the lever arms about a vertical axis. With one or more of the pneumatic piston and shaft cylinders attached to the horizontal flange, the user can perform a twisting exercise intended to strengthen the user's upper back muscles and arms. The number of exercise positions and routine capable of being performed with the present invention are not limited to this discussion but are as numerous as the imagination of the user. The flexibility of the user support pads in combination with the combined vertical and horizontal rotation lever arms have provided an exercise machine with limited versatility.

While I have shown my invention in one form, it will be obvious to those skilled in the art that it is not so limited but is susceptible of various changes and modifications without departing from the spirit thereof.

What I claim is:

1. An exercise machine comprising:

(a) a frame;

(b) a vertical shaft rotatably connected to said frame for rotational movement about a vertical axis; and, c) a means for resisting movement of said vertical shaft about said vertical axis: and, (d) a pair of lever arms each rotatably connected to said vertical shaft on opposite sides thereof for pivotal movement about a common horizontal axis extending through said vertical axis in perpendicular relation thereto such that a user supported by said frame may rotate said lever arms about said horizontal axis or exert the force on said lever arms to urge said vertical shaft in rotational movement about said vertical axis, and (e) rotation means connected to said vertical shaft and engaging said lever arms to selectively facilitate concurrent or independent pivotal movement of said lever arms about said horizontal axis.

2. An exercise machine as described in claim 1 further comprising means for resisting the movement of said lever arms about said horizontal axis.

3. An exercise machine as described in claim 1 further comprising means for locking said vertical shaft in a stationary position.

4. An exercise machine as described in claim 1 further comprising means for locking said lever arms in a stationary position.

5. An exercise machine as described in claim 1 further comprising user support means connected to said frame for supporting a user thereon.

6. An exercise machine as described in claim 1 wherein said vertical shaft comprises:

(a) an elongated tubular member rotatably connected to said frame for rotational movement about said vertical axis; and (b) a horizontal flange coaxially connected to said tubular member for rotational movement therewith.

7. An exercise machine as described in claim 1 wherein said rotation means comprises:

(a) a pair of tubular rotator lever hubs connected to said vertical shaft in diametrically opposed relation thereon and extending horizontally therefrom;

(b) a shaft bore defined by said vertical shaft and said tubular lever hubs and extending horizontally therethrough in coaxial relation to said pair of tubular lever hubs;

(c) a cylindrical rotator shaft received within and extending through said lever hubs and said shaft bore for rotational movement therein about said horizontal axis, wherein opposite ends of said shaft are received within one of said lever arms in longitudinal co-extension therewith; and (d) flange engaging means connected to said lever hubs for holding said lever arms on said shaft.

8. An exercise machine as described in claim 7 wherein each said lever arm comprises:

(a) a tubular shaft engaging portion with an internal diameter substantially the same as an external diameter defined by said shaft such that said opposite ends of said shaft may be received within said lever arms in close fitting contact with an internal surface defined thereby;

(b) a circular first flange connected to said shaft engaging portion proximal a lower end of said lever arm in coaxial relation to said shaft engaging portion, and (c) a circular second flange connected to said shaft engaging portion a predetermined distance from said first flange and in parallel coaxial relation thereto.

9. An exercise machine as described in claim 8 wherein said flange engaging means comprises two pairs of C-shaped semi-circular flange hubs, each connected to one of said lever hubs and engaging one of said first flanges proximate to a corresponding one of said lever hubs such that said shaft engaging portion of said lever arm is held on said shaft for rotational movement thereon about said horizontal axis.

10. An exercise machine as described in claim 6 further comprising means connected to said horizontal flange for locking said vertical shaft in a predetermined stationary position.

11. An exercise machine as described in claim 7 further comprising means connected to said vertical shaft for locking said horizontal shaft in a selected stationary position.

12. An exercise machine as described in claim 7 further comprising means connected to said lever arms to said shaft in fixed on-rotational relation thereto.

13. An exercise machine as described in claim 6 wherein said resisting means comprises:

(a) one or more pneumatic piston and shaft cylinders connected to said frame and detachably connected to said horizontal flange; and (b) means for detachably connecting said one or more pneumatic piston and shaft cylinders to one or more pre-selected points on said horizontal flange, wherein each said point is spaced a unique distance from said vertical axis.

14. An exercise machine as described in claim 13 wherein said detachably connecting means comprises:

(a) a plurality of holes each defined by said horizontal flange a unique distance from said vertical axis; and (b) one or more cylinder pins each connected to one of said one or more piston and shaft cylinders and detachably received within a selected one of said plurality of holes.

15. an exercise machine so described in claim 5 wherein said user support means comprises:

(a) a first pad slidably connected to said frame;

(b) a second pad pivotally connected to said first pad;

(c) a third pad pivotally connected to said first pad opposite said second pad, (d) first support means connected to said frame and said second pad for supporting said second pad in one or more angular relationships with said first pad, and (e) second support means connected to said frame and to said third pad for supporting said third pad in one or more angular relationships with said first pad.

16. An exercise machine as described in claim 8 wherein said resisting means comprises:

(a) one or more pneumatic piston and shaft cylinders connected to said frame and detachably connected to one of either said first or second flanges, and (b) means for detachably connecting said one or more pneumatic piston and shaft cylinders to one or more pre-selected points on either said first or second flanges, wherein each said point is spaced a unique distance from said horizontal axis.

17. An exercise machine as described in claim 16 wherein said detachably connecting means comprises:

(a) a plurality of holes, each defined by either said first or second flanges a unique distance from said horizontal axis, and (b) one or more cylinder pins each connected to one of said one or more piston and shaft cylinders and detachably received within a selected one of said plurality of holes.

* * * * *